US007204230B2

(12) United States Patent
Bevan et al.

(10) Patent No.: US 7,204,230 B2
(45) Date of Patent: Apr. 17, 2007

(54) VEHICLE AND METHOD FOR CONTROLLING AN ENGINE

(75) Inventors: David Bevan, Northville, MI (US); Carol Okubo, Belleville, MI (US); Douglas Martin, Canton, MI (US); Kenneth Miller, Canton, MI (US); Edward Badillo, Canton, MI (US); Matt Smith, Dearborn Heights, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 50 days.

(21) Appl. No.: 10/908,937

(22) Filed: Jun. 1, 2005

(65) Prior Publication Data

US 2006/0272614 A1 Dec. 7, 2006

(51) Int. Cl.
*F02D 41/00* (2006.01)
*F01M 5/00* (2006.01)

(52) U.S. Cl. ..... 123/350; 123/196 AB

(58) Field of Classification Search ..... 123/196 AB, 123/196 S, 196 R, 339.22, 339.24, 350
See application file for complete search history.

(56) References Cited

U.S. PATENT DOCUMENTS

| | | | | |
|---|---|---|---|---|
| 4,592,323 | A | 6/1986 | Vest | |
| 5,070,832 | A | 12/1991 | Hapka et al. | |
| 5,605,128 | A | 2/1997 | Nusser et al. | |
| 5,623,902 | A * | 4/1997 | Nusser et al. | 123/339.16 |
| 6,170,452 | B1 * | 1/2001 | Wisinski | 123/179.4 |
| 6,789,512 | B2 | 9/2004 | Duvinage et al. | |
| 6,915,681 | B2 * | 7/2005 | Kaigawa et al. | 73/118.1 |
| 2005/0039719 | A1 * | 2/2005 | Moss | 123/196 AB |

FOREIGN PATENT DOCUMENTS

| | | |
|---|---|---|
| JP | 63162950 | 7/1988 |
| JP | 2002089309 | 3/2002 |

OTHER PUBLICATIONS

Search Report dated Sep. 28, 2006, 1 page.

* cited by examiner

*Primary Examiner*—Mahmoud Gimie
(74) *Attorney, Agent, or Firm*—David B. Kelley; Brooks & Kushman

(57) ABSTRACT

A vehicle and method for controlling an engine in a vehicle are provided. A temperature of a lubricating fluid in the engine is determined, as are first and second engine speed limits. Operation of the engine at the first engine speed limit is limited to a predetermined time period when the lubricating fluid temperature is between first and second predetermined temperatures. The engine speed is at least temporarily limited to the second engine speed limit after the engine has been operated at the first engine speed limit for the predetermined time period and the lubricating fluid temperature is between the first and second predetermined temperatures.

29 Claims, 4 Drawing Sheets

VEHICLE AND METHOD FOR CONTROLLING AN ENGINE

BACKGROUND OF THE INVENTION

1. Field of the Invention

The present invention relates to a vehicle and a method for controlling an engine which can be in a vehicle.

2. Background Art

Internal combustion engines can be required to operate at many different speeds, and under many different loading conditions. Although most engines include some type of cooling system, for example, a liquid cooling system utilizing a liquid-to-air heat exchanger such as a radiator, the engine may still become very hot during use. At such times, it is possible for a lubricating fluid, such as oil, to reach undesirably high temperatures. This can result in a loss of viscosity and oil pressure which may lead to inadequate lubrication of the engine components.

One attempt to deal with this situation is described in U.S. Pat. No. 5,070,832 issued to Hapka et al. on Dec. 10, 1991. Hapka et al. describes an engine protection system which derates engine performance as a function of fluid parameter fault conditions. Hapka et al. describes two derating schedules based on the level of the fluid parameter fault. In some cases, operation of the vehicle can be continued in a "limp home" mode. In other situations, the engine may be completely shut down.

One limitation of the engine protection system described in Hapka et al. is that once the derating schedules are implemented, the vehicle operator may not be able to operate the engine at a maximum engine speed. The ability to operate the engine at the maximum engine speed, even for a short period of time, may be important to the vehicle operator. Depending on the particular conditions the driver encounters, a short burst of speed may be necessary even when the temperature of the engine oil is above normal.

The issue of high oil temperatures may be particularly relevant to hybrid electric vehicles (HEV's), which may have a relatively small engine. The size of an engine in an HEV may be less than in a conventional vehicle, since many HEV's can combine the output torque of an electric motor with the torque of the engine to drive the vehicle. This allows the size of the engine to be reduced, thereby providing a cost savings and increased fuel economy. There may be times, however, when the motor cannot be used to augment the engine torque. In addition, even if the motor is used to augment the engine torque, certain driving situations—e.g., towing a heavy load, or traveling up a steep slope—may still impose significant loads on this relatively small engine.

Therefore, a need exists for a vehicle and a method for controlling an engine that does not allow the temperature of the engine oil to reach unacceptably high levels, yet at the same time, allows the vehicle operator to operate the engine at the maximum engine speed, for at least a short period of time, under certain conditions.

SUMMARY OF THE INVENTION

One advantage of the present invention is that it provides a method for controlling an engine to help ensure that the temperature of a lubricating fluid does not get unreasonably high, and yet allows the engine to be operated at maximum speed for at least some predetermined period of time, under certain conditions.

Another advantage of the present invention is that it provides a method for controlling an engine that allows a constraint on the engine speed to be overridden under certain conditions for at least a predetermined period of time.

The invention also provides a method for controlling an engine having a lubricating fluid. The method includes determining a temperature of the lubricating fluid, and determining a first engine speed limit. A first control logic is executed when the lubricating fluid temperature is between a first predetermined temperature and a second predetermined temperature which is higher than the first predetermined temperature. The first control logic is programmed to allow the engine to be operated at the first engine speed limit for any time period less than a predetermined time period. The first control logic is also programmed to automatically reduce the engine speed after the engine has been operated at the first engine speed limit for the predetermined time period.

The invention further provides a method for controlling an engine in a vehicle. The engine uses a lubricating fluid, and the method includes determining a temperature of the lubricating fluid. A first engine speed limit and a second engine speed limit lower than the first engine speed limit are also determined. Operation of the engine at the first engine speed limit is limited to a predetermined time period when the lubricating fluid temperature is between a first predetermined temperature and a second predetermined temperature higher than the first predetermined temperature. The engine speed is at least temporarily limited to the second engine speed limit after the engine has been operated at the first engine speed limit for the predetermined time period and the lubricating fluid temperature is between the first and second predetermined temperatures.

The invention also provides a vehicle including an engine using a lubricating fluid. A sensor is used for sensing a parameter related to a temperature of the lubricating fluid, and is configured to output a signal related to the sensed parameter. A control system is in communication with the sensor and includes at least one controller. The control system is configured to limit operation of the engine at the first engine speed limit to a predetermined time period when the lubricating fluid temperature is between a first predetermined temperature and a second predetermined temperature higher than the first predetermined temperature. The control system is also configured to automatically reduce the engine speed after the engine has been operated at the first engine speed limit for the predetermined time period and the lubricating fluid temperature is between the first and second predetermined temperatures.

DETAILED DESCRIPTION OF THE PREFERRED EMBODIMENT(S)

Figure 1:
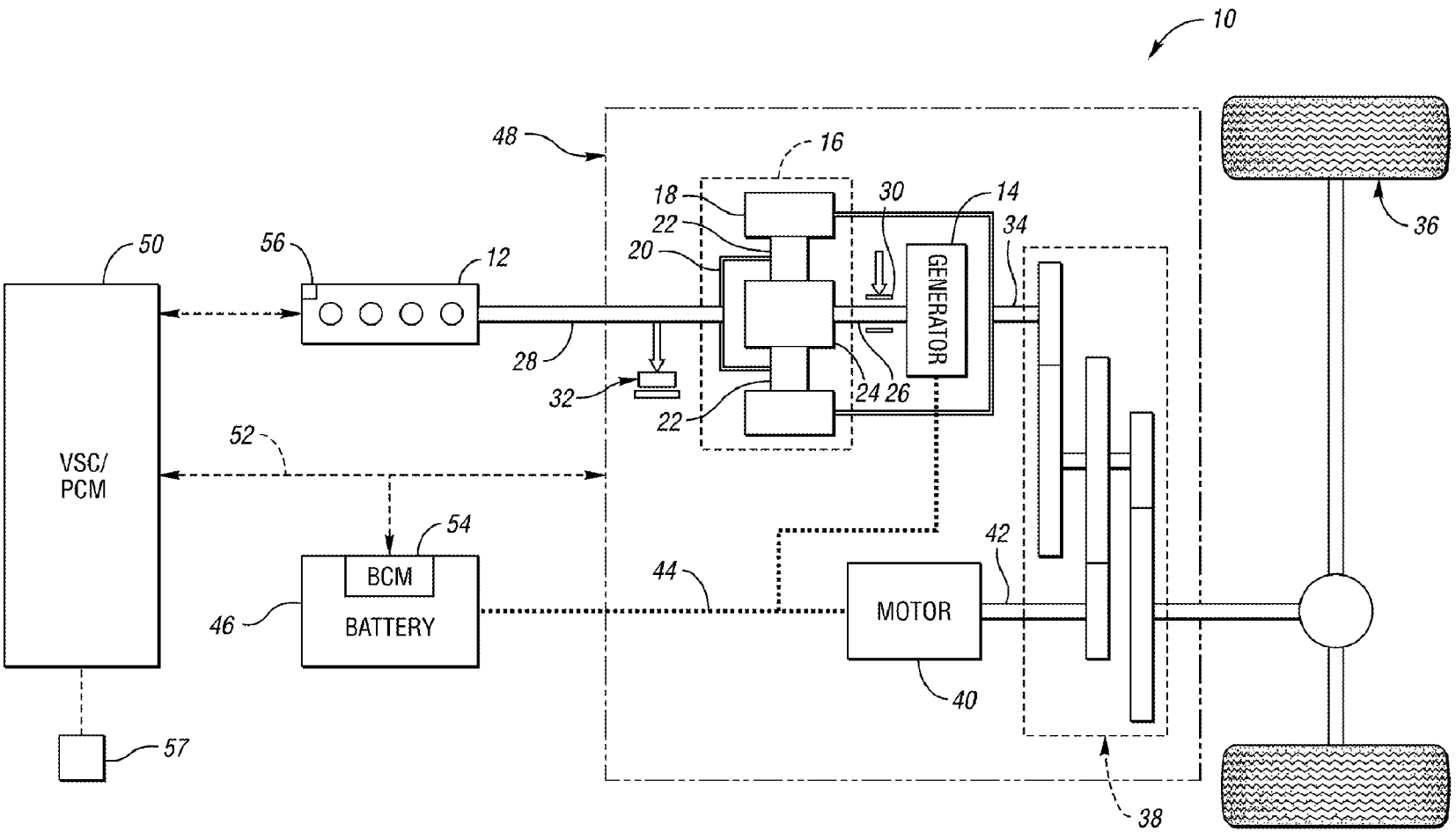
FIG. 1 is a schematic representation of a vehicle in accordance with the present invention.

FIG. 1 shows a schematic representation of a vehicle 10 in accordance with one embodiment of the present invention. The vehicle 10 includes an engine 12 and an electric machine, or generator 14. The engine 12 and the generator 14 are connected through a power transfer unit, which in this embodiment is a planetary gear set 16. Of course, other types of power transfer units, including other gear sets and transmissions may be used to connect the engine 12 to the generator 14. The planetary gear set includes a ring gear 18, a carrier 20, planet gears 22, and a sun gear 24.

The generator 14 can also be used as a motor, outputting torque to a shaft 26 connected to the sun gear 24. Similarly, the engine 12 outputs torque to a shaft 28 connected to the carrier 20. The torque output from the engine 12 can be used to drive the vehicle 10, it can be used to spin the shaft 26 to operate the generator 14, or it can provide torque to drive the vehicle 10 and operate the generator 14, simultaneously. A brake 30 is provided for stopping rotation of the shaft 26, thereby locking the sun gear 24 in place. Because this configuration allows torque to be transferred from the generator 14 to the engine 12, a one-way clutch 32 is provided so that the shaft 28 rotates in only one direction. Having the generator 14 operatively connected to the engine 12, as shown in FIG. 1, allows the speed of the engine 12 to be controlled by the generator 14.

The ring gear 18 is connected to a shaft 34, which is connected to vehicle drive wheels 36 through a second gear set 38. The vehicle 10 includes a second electric machine, or motor 40, which can be used to output torque to a shaft 42. Other vehicles within the scope of the present invention may have different electric machine arrangements, such as more or less than two electric machines. In the embodiment shown in FIG. 1, the motor 40 and the generator 14 can both be used as motors to output torque, for example, to drive the vehicle 10. The torque output from either or both of the motor 40 and the generator 14 can also be combined with the torque output from the engine 12 to drive the vehicle 10. Alternatively, the motor 40 and the generator 14 can each be used as a generator, outputting electrical power to a high voltage bus 44 and to an energy storage device, or battery 46.

The battery 46 is a high voltage battery that is capable of outputting electrical power to operate the motor 40 and the generator 14. Other types of energy storage devices and/or output devices can be used with a vehicle, such as the vehicle 10. For example, a device such as a capacitor can be used, which, like a high voltage battery, is capable of both storing and outputting electrical energy. Alternatively, a device such as a fuel cell may be used in conjunction with a battery and/or capacitor to provide electrical power for the vehicle 10.

As shown in FIG. 1, the motor 40, the generator 14, the planetary gear set 16, and a portion of the second gear set 38 may generally be referred to as a transaxle 48. To control the engine 12 and the components of the transaxle 48—e.g., the generator 14 and motor 40—a control system, including a controller 50, is provided. As shown in FIG. 1, the controller 50 is a combination vehicle system controller and powertrain control module (VSC/PCM). Although it is shown as a single hardware device, it may include multiple controllers in the form of multiple hardware devices, or multiple software controllers within one or more hardware devices.

A controller area network (CAN) 52 allows the VSC/PCM 50 to communicate with the transaxle 48 and a battery control mode (BCM) 54. Just as the battery 46 has the BCM 54, other devices controlled by the VSC/PCM 50 may have their own controllers. For example, an engine control unit (ECU) may communicate with the VSC/PCM 50 and may perform control functions on the engine 12. In addition, the transaxle 48 may include one or more controllers, such as a transaxle control module (TCM), configured to control specific components within the transaxle 48, such as the generator 14 and/or the motor 40. Some or all of these controllers may be a part of a control system for the present invention. It is worth noting that although the vehicle 10, shown in FIG. 1, is an HEV, it is understood that the present invention contemplates the use of other types of vehicles.

FIG. 1 also shows a sensor 56 at the engine 12. The sensor 56 provides input to the VSC/PCM 50 related to a temperature of the lubricating fluid—i.e., the oil—in the engine 12. The sensor 56 can be a temperature sensor directly in contact with a portion of the engine oil, or alternatively, can measure a temperature of another portion of the engine 12, such as the cylinder head. Of course, a temperature of the oil in the engine 12 may be inferred from other parameters, such as the engine speed, and the time that the engine 12 is operated at that speed. Thus, there are any number of inputs which can be used by the VSC/PCM 50 to determine the temperature of the engine oil. The vehicle 10 also includes an accelerator pedal 57, which can communicate its position to the VSC/PCM 50. The position of the accelerator pedal 57 is indicative of driver demand, and the position signal received by the VSC/PCM 50 can be used in a method of the present invention, as described more fully below.

Figure 2:
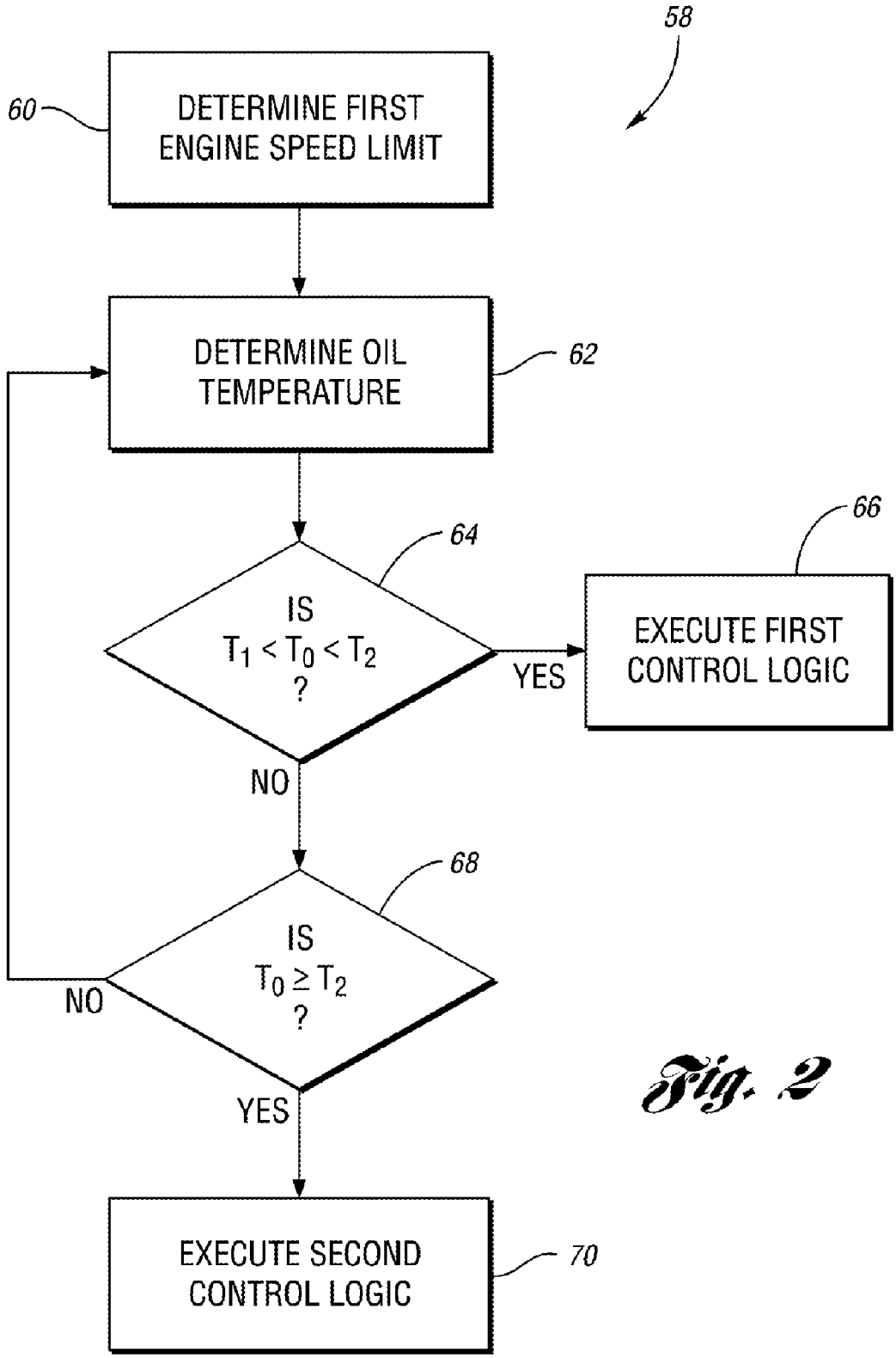
FIG. 2 is a flow chart illustrating a method in accordance with the present invention.

FIG. 2 shows a flow chart 58 that illustrates a method of the present invention in a simplified schematic form. It is worth noting at the outset that although the various steps illustrated in the flow chart 58 are shown as occurring in some chronological sequence, the steps may be performed in some other sequence, and some of the steps may even be performed simultaneously. At the first step 60, shown in FIG. 2, a first engine speed limit is determined. This speed limit may be based on such things as the mechanical limits of the engine, or some desired maximum speed based on other considerations. Using the vehicle 10 shown in FIG. 1 for reference, the first engine speed limit would be programmed into the VSC/PCM. Of course, this parameter, as well as other parameters and control logics described herein, could be programmed into one or more different controllers which communicate with each other and the various vehicle systems.

At step 62, a temperature of the engine oil is determined. As discussed above, this determination can be made by direct measurement, or it can be inferred. Next, at decision block 64, it is determined if the temperature of the oil ($T_O$) is between first and second predetermined temperatures ($T_1$), ($T_2$). The first predetermined temperature ($T_1$) can be chosen to represent a normal engine oil operating temperature, such that a first control logic, which allows the engine 12 to be operated in a first mode, will only be executed after the engine oil temperature is relatively warm. Conversely, the first predetermined temperature ($T_1$) may be chosen to be a very low temperature, such as −10° F. In such a case, the first control logic can be available for execution at or near engine startup, even in very cold conditions.

The second predetermined temperature ($T_2$) can be chosen to be a critical oil temperature, above which the oil properties may undesirably degrade. For example, such a temperature may be at or near 285° F. As shown in FIG. 2, if the determined engine oil temperature ($T_O$) is between the first and second predetermined temperatures, a first control logic is executed at step 66. The first control logic, which is explained more fully below, is programmed into the VSC/PCM 50. It is worth noting that although the method described in FIG. 2 refers to first and second control logics, it is understood that these logics may be parts of a single program which is merely executed under different conditions. Moreover, some or all of each of the control logics could be programmed into different controllers.

If, at step 64, it is determined that the temperature of the oil ($T_0$) is not between the first and second predetermined temperatures, it is next determined at decision block 68 whether the temperature of the oil ($T_0$) is at least as high as the second predetermined temperature ($T_2$). If not, the method loops back to step 62, where the temperature of the oil is again determined. If, however, the temperature of the oil ($T_0$) is at least as high as the second predetermined temperature ($T_2$), then a second control logic, which allows the engine 12 to be operated in a second mode, is executed at step 70.

Figure 3:
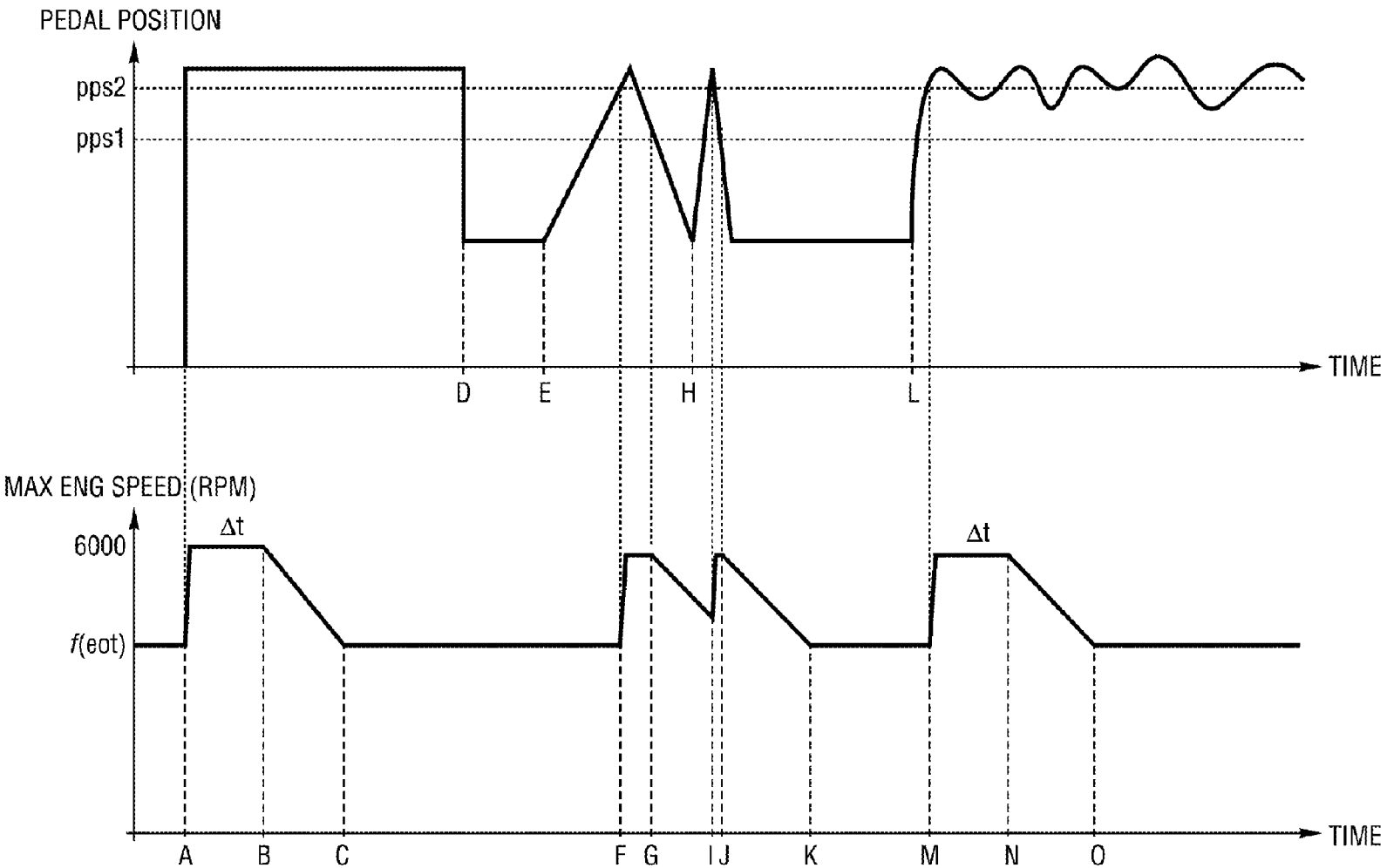
FIG. 3 shows two graphs in a time domain illustrating control logic of the present invention.

The details of the method illustrated in FIG. 2, are now described with reference to FIG. 3, and with further reference to the vehicle 10, shown in FIG. 1. FIG. 3 shows two graphs, each of which are in a time domain. The upper graph plots the position of the accelerator pedal 57 versus time, while the lower graph plots the maximum engine speed versus time. The first engine speed limit, referred to in step 60 in FIG. 2, is shown as 6,000 RPM in the lower graph of FIG. 3.

Between points A and B, the engine 12 is permitted to be operated at the first engine speed limit. If the temperature of the engine oil ($T_0$) was below the first predetermined temperature ($T_1$), the speed of the engine 12 may be further limited, at least until the oil temperature ($T_0$) increased beyond the first predetermined temperature ($T_1$). As shown in FIG. 3, the operation of the engine 12 between points A and B takes place while the engine oil temperature ($T_0$) is between the first and second predetermined temperatures. Thus, the first control logic is executed and a timer is actuated at point A to keep a running clock on how long the engine 12 is operated at the first engine speed limit. Such a timer can be integrated into a controller, such as the VSC/PCM 50, or it may be a separate hardware device in communication with the VSC/PCM 50.

When it is determined that the engine 12 has been operating at the first engine speed limit (6,000 RPM) for a predetermined time period ($\Delta t$), the VSC/PCM 50 acts to automatically reduce the engine speed starting at point B. The predetermined time period ($\Delta t$) can be based on a knowledge of engine operation and oil temperature. In one embodiment of the present invention, the predetermined time period ($\Delta t$) is set to a value between 15 seconds and 30 seconds. As shown in FIG. 3, the engine speed is gently lowered from point B to point C. This ramped decreasing speed is programmed directly into the VSC/PCM 50 as part of the first control logic. It can be input as a decreasing rate limit which can provide a steeper or more gentle decreasing speed control, as desired.

Observing the pedal position graph from points A to C, it is shown that the position of the accelerator pedal 57 at point A goes from zero to some relatively high position, above pedal positions (pps1), (pps2). This represents a "tip-in," wherein a vehicle operator actuates the accelerator pedal 57 to a fully wide open position. As shown in FIG. 3, the accelerator pedal 57 remains fully open beyond point B; however, as shown in the lower graph, the engine speed is automatically reduced by the control logic programmed into the VSC/PCM 50. This logic helps to ensure that the engine oil temperature will not become impermissibly high, regardless of driver demand.

At point C, the engine speed has been reduced to a predetermined engine speed, or a second engine speed limit, where it is at least temporarily maintained. As shown in FIG. 3, the second engine speed limit is a function of the engine oil temperature (f(eot)). The value of the second engine speed limit in the embodiment shown in FIG. 3 is approximately 4000 RPM, though the present invention contemplates other values. At point D, shown in the pedal position graph, the position of the accelerator pedal 57 is reduced below (pps1), which is a first predetermined pedal position. The change in pedal position does not affect the engine speed, however, since this has already been reduced by execution of the first control logic.

In order to provide a vehicle operator with as much flexibility as possible, the first control logic is programmed to reset the timer based on driver demand. In one embodiment, the driver demand is determined based on accelerator pedal position. As shown in FIG. 3, for example, whenever the accelerator pedal position is changed from a position that indicates a driver demand of at least the first engine speed limit—e.g., a wide open pedal position—to a position at or below the first predetermined pedal position (pps1). Therefore, when the vehicle operator increases the accelerator pedal position at point E, the engine speed will again be allowed to increase to the first engine speed limit; however, the increase will not be allowed to occur until the position of the accelerator pedal 57 reaches at least (pps2), a second pedal position. Thus, as the pedal position increases from point E to point F, the speed of the engine 12 remains constant at the second engine speed limit.

Although the increase in engine speed shown at point F appears to happen almost instantaneously, it really occurs in accordance with an increasing rate limit programmed into the first control logic in the VSC/PCM 50. As with the decreasing rate limit, the increasing rate limit can be configured to provide faster or slower speed changes, as desired. Because vehicle operation may require a fast speed increase, and because the vehicle operator may expect a fast increase, the increasing rate limit may be much steeper than the decreasing rate limit. This is the case shown in FIG. 3.

It is worth noting that in addition to the increasing and decreasing rate limits programmed into the first control logic, a feedback integrator term may also be included to help further adjust the engine speed changes. In particular, a feedback signal can be used in a determination of the slope of either the increasing rate limit or the decreasing rate limit. For example, a feedback signal indicative of engine oil temperature can be used to determine the slope of either rate limit when it is used. Thus, it is possible to make the slope of the decreasing rate limit steeper when the engine oil temperature is higher, thereby reducing the engine speed more quickly.

In the pedal position profile shown in FIG. 3, the pedal position increases from point E to a fully open position. Almost immediately, the pedal position begins to decrease, which, under certain control conditions, might cause the engine speed to immediately decrease. Because the oil temperature ($T_0$) is between the first and second predetermined temperatures, however, control of the engine 12 is in accordance with the first control logic. Therefore, the speed of the engine 12 does not immediately decrease when the pedal position starts to decrease. Rather, the speed of the engine 12 is maintained at the first engine speed limit (6,000 RPM) until the pedal position reaches the first predetermined pedal position at point G.

Decreasing the pedal position past this point does cause the engine speed to drop, but again, it is in accordance with the decreasing rate limit. At point H, the pedal position is again increased, but as before, the engine speed is not increased until the pedal position goes beyond the second pedal position (pps2) at point I. At point I, the pedal position is again reduced, but the engine speed is maintained until the pedal position reaches the first predetermined pedal position (pps1) at point J. Because the pedal position is maintained at this reduced level for some time, the engine speed ramps down in accordance with the decreasing rate limit until it reaches the second engine speed limit at point K.

As shown in FIG. 3, the engine 12 is allowed to be operated at the first engine speed limit (6,000 RPM) between points F and G and points I and J without being automatically reduced. This is because the time lapse between points F and G and points I and J is not as long as the predetermined time period (Δt). Moreover, the first control logic allows a vehicle operator to essentially override the limiting of the engine speed to the second engine speed limit by reducing the pedal position beyond the first predetermined pedal position (pps1). This provides flexibility and added control for the vehicle operator, which is acceptable while the engine oil temperature ($T_0$) is between the first and second predetermined temperatures.

At point L, the pedal position is again increased from below the first predetermined pedal position (pps1) to some level beyond the second pedal position (pps2), for example, to a fully open position. As before, the speed of the engine 12 is maintained until the pedal position reaches the second pedal position (pps2) at point M. After point M, the pedal position fluctuates from above the second pedal position (pps2) to points that are below the second pedal position (pps2), but still above the first predetermined pedal position (pps1). Therefore, as shown in the lower graph in FIG. 3, the engine speed is allowed to be maintained at the first engine speed limit (6,000 RPM) for the predetermined time period of Δt.

After the predetermined time period (Δt) has elapsed, the engine speed is automatically reduced at point N, to the second engine speed limit at point O. Despite the fluctuations in the pedal position beyond point O, the speed of the engine 12 is not allowed to increase, because the pedal position is never reduced to the first predetermined pedal position (pps1). Thus, the timer is not reset, the engine operator has not overridden the second engine speed limit, and the speed of the engine 12 is maintained.

Referring to FIG. 2, it was noted that a second control logic would be executed if the temperature of the engine oil ($T_0$) increased to the second predetermined temperature ($T_2$). The second control logic maintains the engine speed at the second engine speed limit, and does not allow the vehicle operator to override that speed limit, even when the pedal position is reduced below the first predetermined pedal position (pps1). Moreover, if it is determined that the temperature of the engine oil ($T_0$) gets too high—e.g., if it reaches a third predetermined temperature higher than the second predetermined temperature—the second control logic can further reduce the speed of the engine 12 to a third engine speed limit lower than the second engine speed limit. Thus, whereas the first control logic helps to prevent the engine oil from overheating, the second control logic may be utilized to help reduce the engine oil temperature.

The use of the first and second control logics, as described in conjunction with FIG. 3, may be particularly useful when the first engine speed limit is determined based on a fully open accelerator pedal position. For example, in the upper graph in FIG. 3, pedal positions beyond the second pedal position (pps2) may be considered fully open accelerator pedal positions, and the first engine speed limit (6,000 RPM) can be set based on the wide open accelerator pedal position. It may also be desirable to provide an engine speed limit that is based on an accelerator pedal position that is less than the fully open position. For example, if a vehicle operator holds the accelerator pedal 57 at a constant position, or for example, if the cruise control is set, the vehicle speed will remain relatively constant while the engine speed may fluctuate depending on driving conditions. In such cases, it may be desirable to limit the speed of the engine 12 to some engine speed limit, to help ensure that the engine oil temperature ($T_0$) does not get too hot.

Figure 4:
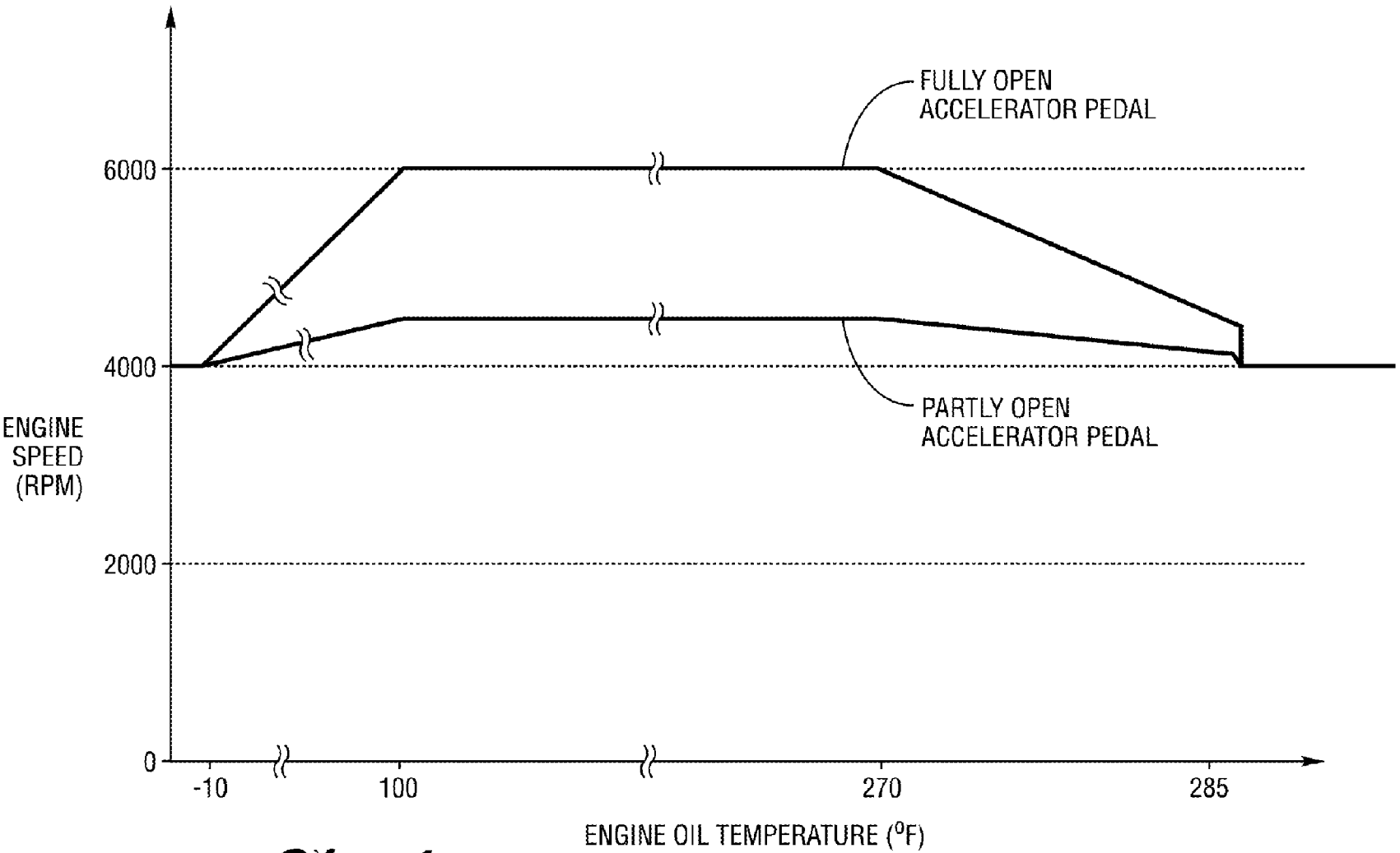
FIG. 4 shows a graph in a temperature domain illustrating control logic of the present invention.

FIG. 4 shows a graph that includes two curves: the upper curve represents an engine speed limit curve for a fully open accelerator pedal position, while the lower curve represents an engine speed limit curve for a partly open accelerator pedal position. The upper curve shown in FIG. 4 can be related to the curves shown in FIG. 3, where the first engine speed limit shown in FIG. 3 was determined based on a fully open accelerator pedal position. In FIG. 4 it is shown that the engine speed is limited based on the engine oil temperature. This can be related to the control logic as described in FIG. 3, in that operating the engine 12 at the first engine speed limit (6,000 RPM) for the predetermined period of time (Δt) will likely cause an increase in the engine oil temperature. The upper curve in FIG. 4 illustrates the relationship between the engine speed limit and the engine oil temperature.

For the lower curve shown in FIG. 4, which is for a partly open accelerator pedal position, the time limitations can be removed, and the engine speed limited only by engine oil temperature. For example, the VSC/PCM 50 can be programmed with a fourth engine speed limit, such as 4,500 RPM, as shown in FIG. 4. This fourth engine speed limit is lower than the first engine speed limit (6,000 RPM), but is higher than the second engine speed limit (f(eot), which, as noted above, may be approximately 4,000 RPM) in one embodiment.

As shown in FIG. 4, when the accelerator pedal 57 is partly open, and the engine oil temperature is at least as high as a first predetermined temperature (100° F. in FIG. 4), the engine 12 is allowed to operate at the fourth engine speed limit (4,500 RPM) until the engine oil temperature reaches another predetermined temperature, such as 270° F. in FIG. 4. At this point, the first control logic still limits the engine speed in accordance with the lower curve in FIG. 4 as long as the accelerator pedal is only partly open. If, however, the driver fully opens the accelerator pedal, the first control logic will allow the engine speed to increase up to the level of the upper curve shown in FIG. 4.

Once the engine oil temperature reaches the second predetermined temperature (285° F. in FIG. 4), for a partly open accelerator pedal position, the second control logic will automatically reduce the engine speed down to the second engine speed limit (4,000 RPM). Thus, the upper and lower curves, respectively representing fully open and partly open accelerator pedal positions, will be controlled the same for very high engine oil temperatures. In addition, as shown in FIG. 4, the fully open and partly open accelerator pedal positions can be controlled the same for relatively low engine oil temperatures. Thus, below −10° F. the engine speed is limited to the second engine speed limit, regardless of the accelerator pedal position. This helps to ensure that the engine 12 is not operated at a high speed when the engine oil is so cold that its ability to adequately lubricate the engine components is compromised. It is understood that although specific engine speeds and oil temperatures have been used to illustrate specific embodiments of the present invention, different speeds, temperatures and time periods are also contemplated by the present invention.

While the best mode for carrying out the invention has been described in detail, those familiar with the art to which this invention relates will recognize various alternative designs and embodiments for practicing the invention as defined by the following claims.

What is claimed is:

1. A method for controlling an engine having a lubricating fluid, the method comprising:

determining a temperature of the lubricating fluid;

determining a first engine speed limit; and executing a first control logic when the lubricating fluid temperature is between a first predetermined temperature and a second predetermined temperature higher than the first predetermined temperature, the first control logic being programmed to:

allow the engine to be operated at the first engine speed limit for any time period less than a predetermined time period, and automatically reduce the engine speed after the engine has been operated at the first engine speed limit for the predetermined time period.

2. The method of claim 1, wherein the first control logic is further programmed to:

determine a decreasing rate limit which controls how quickly the engine speed is automatically reduced, and perform the automatic reduction in engine speed in accordance with the decreasing rate limit.

3. The method of claim 2, wherein the first control logic is further programmed to use the temperature of the lubricating fluid as a feedback signal in the determination of the decreasing rate limit.

4. The method of claim 1, the engine being operable to drive a vehicle, the method further comprising determining a driver demand, and wherein the first control logic is further programmed to:

actuate a timer to determine how long the engine is operated at the first engine speed limit, reset the timer when the driver demand changes from at least the first engine speed limit to below a first predetermined driver demand of less than the first engine speed limit, and allow the engine to be operated at the first engine speed limit for any time period less than the predetermined time period each time the timer is reset.

5. The method of claim 4, the vehicle including an accelerator pedal for communicating the driver demand, and wherein the timer is reset when the accelerator pedal position changes from a position indicating a driver demand of at least the first engine speed limit to a position at or below a first predetermined pedal position, the first predetermined pedal position indicating a driver demand of less than the first engine speed limit.

6. The method of claim 5, wherein the first control logic is further programmed to:

increase the engine speed to the first engine speed limit when the accelerator pedal position is increased to a position that exceeds a second pedal position after the timer is reset, the second pedal position indicating a driver demand of at least the first engine speed limit, and maintain the engine speed at the first engine speed limit when the accelerator pedal position is reduced to a position less than the second pedal position and more than the first pedal position.

7. The method of claim 6, wherein the first control logic is further programmed to reduce the engine speed when the accelerator pedal position is reduced to at least the first pedal position.

8. The method of claim 1, wherein the first control logic is further programmed to automatically reduce the engine speed from the engine speed limit to a predetermined engine speed after the engine has been operated at the first engine speed limit for the predetermined time period, the predetermined engine speed being a function of the lubricating fluid temperature.

9. The method of claim 8, further comprising executing a second control logic when the lubricating fluid temperature is at or above the second predetermined temperature, the second control logic being programmed to:

set a second engine speed limit equal to the predetermined engine speed, and control the engine speed such that it does not exceed the second engine speed limit.

10. The method of claim 9, further comprising determining a third engine speed limit lower than the second engine speed limit, and wherein the second control logic is further programmed to control the engine speed such that it does not exceed the third engine speed limit when the lubricating fluid temperature is at or above a third predetermined temperature higher than the second predetermined temperature.

11. The method claim 10, the engine being operable to drive a vehicle, the vehicle including an accelerator pedal for communicating a driver demand, wherein the first engine speed limit is determined for a fully open accelerator pedal, the method further comprising determining a fourth engine speed limit, lower than the first engine speed limit and higher than the second engine speed limit, and wherein the first control logic is further programmed to control the engine speed such that it does not exceed the fourth engine speed limit when the accelerator pedal is less than fully open.

12. The method of claim 11, wherein the second control logic is further programmed to automatically reduce the engine speed from the fourth engine speed limit to the second engine speed limit when the accelerator pedal is less than fully open.

13. A method for controlling an engine in a vehicle, the engine using a lubricating fluid, the method comprising:

determining a temperature of the lubricating fluid;

determining a first engine speed limit;

determining a second engine speed limit lower than the first engine speed limit;

limiting operation of the engine at the first engine speed limit to a predetermined time period when the lubricating fluid temperature is between a first predetermined temperature and a second predetermined temperature higher than the first predetermined temperature; and at least temporarily limiting the engine speed to the second engine speed limit after the engine has been operated at the first engine speed limit for the predetermined time period and the lubricating fluid temperature is between the first and second predetermined temperatures.

14. The method of claim 13, the vehicle including an accelerator pedal for communicating a driver demand, the method further comprising:

overriding the at least temporary limiting of the engine speed to the second engine speed limit when the lubricating fluid temperature is between the first and second predetermined temperatures and the accelerator pedal position is changed from a position indicating a driver demand of at least the first engine speed limit to a position at or below a first predetermined pedal position, thereby allowing the engine to be operated at a speed higher than the second engine speed limit.

15. The method of claim 13, wherein the second engine speed limit is a function of the lubricating fluid temperature.

16. The method of claim 13, further comprising limiting the engine speed to the second engine speed limit when the lubricating fluid temperature is at or above the second predetermined temperature.

17. The method of claim 16, further comprising:

determining a third engine speed limit lower than the second engine speed limit; and limiting the engine speed to the third engine speed limit when the temperature of the lubricating fluid is at or above a third predetermined temperature higher than the second predetermined temperature.

18. The method of claim 17, the vehicle including an accelerator pedal for communicating a driver demand, wherein the first engine speed limit is determined for a fully open accelerator pedal, the method further comprising:

determining a fourth engine speed limit, lower than the first engine speed limit and higher than the second engine speed limit; and limiting the engine speed such that it does not exceed the fourth engine speed limit when the accelerator pedal is less than fully open and the lubricating fluid temperature is between the first and second predetermined temperatures.

19. The method of claim 18, wherein the second control logic is further programmed to automatically reduce the engine speed from the fourth engine speed limit to the second engine speed limit when the accelerator pedal is less than fully open and the lubricating fluid temperature is at or above the second predetermined temperature.

20. A vehicle, comprising:

an engine using a lubricating fluid;

a sensor for sensing a parameter related to a temperature of the lubricating fluid, and for outputting a signal related to the sensed parameter; and a control system in communication with the sensor and including at least one controller, the control system being configured to:

limit operation of the engine at the first engine speed limit to a predetermined time period when the lubricating fluid temperature is between a first predetermined temperature and a second predetermined temperature higher than the first predetermined temperature, and automatically reduce the engine speed after the engine has been operated at the first engine speed limit for the predetermined time period and the lubricating fluid temperature is between the first and second predetermined temperatures.

21. The vehicle of claim 20, further comprising an electric machine operable as a motor to provide torque to drive the vehicle.

22. The vehicle of claim 21, wherein the engine is operable to provide torque which can be combined with the torque output from the electric machine to drive the vehicle, thereby allowing the size of the engine to be reduced.

23. The vehicle of claim 20, wherein the control system is further configured to at least temporarily limit the engine speed to a second engine speed limit lower than the first engine speed limit after the engine speed has been automatically reduced.

24. The vehicle of claim 23, further comprising an accelerator pedal in communication with the control system for communicating a driver demand, and wherein the control system is further configured to override the at least temporary limiting of the engine speed to the second engine speed limit when the lubricating fluid temperature is between the first and second predetermined temperatures and the accelerator pedal position is changed from a position indicating a driver demand of at least the first engine speed limit to a position at or below a first predetermined pedal position, thereby allowing the engine to be operated at a speed higher than the second engine speed limit.

25. The vehicle of claim 23, wherein the second engine speed limit is a function of the lubricating fluid temperature.

26. The vehicle of claim 23, wherein the control system is further configured to limit the engine speed to the second engine speed limit when the lubricating fluid temperature is at or above the second predetermined temperature.

27. The vehicle of claim 26, wherein the control system is further configured to limit the engine speed to a third engine speed limit lower than the second engine speed limit when the temperature of the lubricating fluid is at or above a third predetermined temperature higher than the second predetermined temperature.

28. The vehicle of claim 27, further comprising an accelerator pedal in communication with the control system for communicating a driver demand, and wherein the control system is further configured to limit the engine speed to a fourth engine speed limit when the accelerator pedal is less than fully open and the lubricating fluid temperature is between the first and second predetermined temperatures, the fourth engine speed limit being lower than the first engine speed limit and higher than the second engine speed limit.

29. The vehicle of claim 28, wherein the control system is further configured to automatically reduce the engine speed from the fourth engine speed limit to the second engine speed limit when the accelerator pedal is less than fully open and the lubricating fluid temperature is at or above the second predetermined temperature.

* * * * *